United States Patent [19]

Suzuki et al.

[11] Patent Number: 4,725,210

[45] Date of Patent: Feb. 16, 1988

[54] OILLESS ROTARY-TYPE COMPRESSOR SYSTEM

[75] Inventors: Akira Suzuki, Atsugi; Masakazu Aoki, Ebina, both of Japan

[73] Assignee: Hitachi, Ltd., Tokyo, Japan

[21] Appl. No.: 917,036

[22] Filed: Oct. 9, 1986

[30] Foreign Application Priority Data

Oct. 9, 1985 [JP] Japan ..... 60-223501
Feb. 10, 1986 [JP] Japan ..... 61-25881

[51] Int. Cl.[4] ..... F04C 18/16; F04C 29/02; F04C 29/04

[52] U.S. Cl. ..... 418/83; 418/85; 418/88; 418/101; 418/201

[58] Field of Search ..... 418/83, 85, 88, 101, 418/201

[56] References Cited

U.S. PATENT DOCUMENTS

| | | | |
|---|---|---|---|
| 3,008,631 | 11/1961 | Paugh | 418/101 |
| 3,291,385 | 12/1966 | Williams et al. | 418/85 |
| 4,174,196 | 11/1979 | Mori et al. | 418/85 |
| 4,529,363 | 7/1985 | Suzuki | 418/201 |

FOREIGN PATENT DOCUMENTS

| | | | |
|---|---|---|---|
| 59-93985 | 5/1984 | Japan | 418/83 |
| 60-85286 | 5/1985 | Japan | 418/83 |
| 60-166785 | 8/1985 | Japan | 418/83 |

*Primary Examiner*—John J. Vrablik
*Attorney, Agent, or Firm*—Antonelli, Terry & Wands

[57] ABSTRACT

An oilless rotary compressor system including an oilless rotary compressor, a radiator, a precooler, a cooler and a check valve. Heat resulting from a compression by the oilless rotary compressor is carried to the radiator through an aqueous solution of propylene glycol which flows through the oilless rotary compressor and precooler in this order and is dispersed into the atmosphere.

10 Claims, 1 Drawing Figure

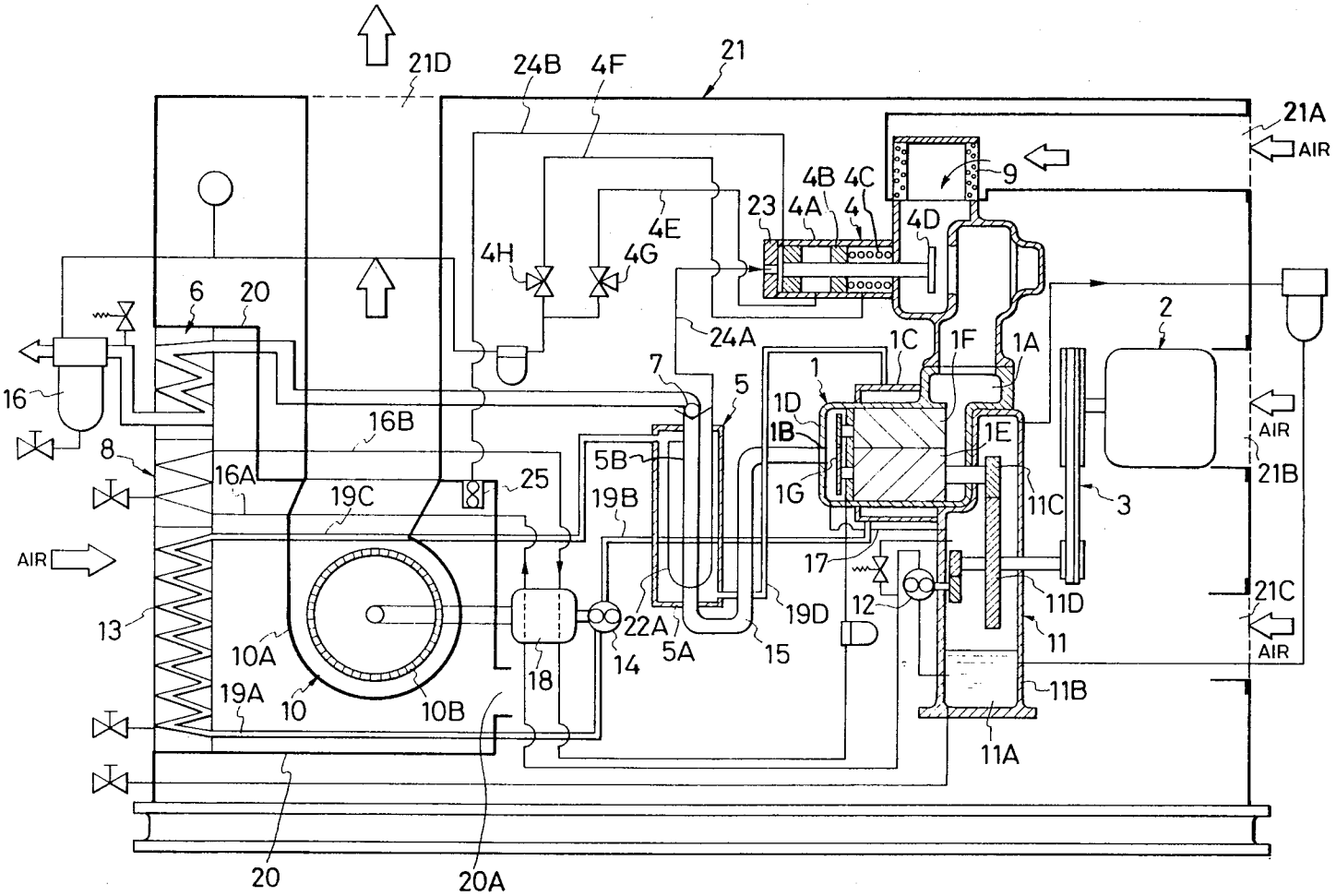
21A
AIR
AIR
21B
21C
AIR
2
3
11D
11
11B
11C
1A
1E
11A
9
1F
4D
1C
12
4C
4
4B
4A
1
17
1D
1B
1G
19D
23
15
21
24A
5
5A
7
4E
4G
22A
14
5B
19B
4F
24B
4H
25
18
20A
21D
10B
16B
19C
10
20
10A
19A
16A
6
8
13
16
AIR

OILLESS ROTARY-TYPE COMPRESSOR SYSTEM

BACKGROUND OF THE INVENTION

The present invention relates to a compressor system and, more particularly, to a rotary-type compressor system in which no oil is supplied into the operating space thereof.

In, for example, U.S. Pat. No. 4,529,363, a single-stage oil-free screw-type compressor of the aforementioned type is proposed which includes, inter alia, a precooler, a cooler, a transmission device, and a check valve, with the compressor system utilizing water as a medium for cooling the precooler and the cooler.

A disadvantage of the above-described rotary-type compressor resides in the fact that the compressor must use tap water or underground water as a medium for cooling the precooler and the cooler. Consequently, it is impossible to install such a system at a site or location where no tap water or underground water is available.

A further disadvantage of the above-proposed compressor system resides in the fact that, when changing the installation site of the system, the piping for the cooling water must be removed and reinstalled which is not only inconvenient but also somewhat expensive.

Cooling water, more particularly tap water, is corrosive and, since the precooler and cooler are made of a copper or aluminum material, they are subject to corrosion. A cooling water passage may become partially or completely blocked because of rust or sludge resulting from the corrosion of the precooler or the cooler. Consequently, it is necessary to carry out frequent inspection and maintenance of the system, including removal of the rust and sludge and cleaning of the passage.

Accordingly, an object of the present invention resides in providing an oilless rotary-type compressor system which is operable at a site where it is either difficult to supply cooling water or where the quality of water is poor.

Another object of the present invention resides in providing an oilless rotary-type compressor system which minimizes corrosion caused by the cooling medium to such an extent that no operational problems are experienced.

In accordance with advantageous features of the present invention, an oilless rotary-type compressor is provided which includes a radiator having a fan and a heat exchanger, with the radiator being connected through a piping or conduit system to a jacket of a compressor body and a precooler so that a heat transfer medium for cooling is sequentially circulated through the radiator, the jacket of the compressor body and the precooler.

Accordingly, by virtue of the features of the present invention, the radiator, the jacket of the compressor body and the precooler together form a circulation circuit through which the heat transfer medium for cooling is circulated, whereby it is possible to disperse heat generated by the compressor body and the precooler without a cooling medium such as, for example, water. An aqueous solution of non-polluting propylene glycol, an approved food additive, is employed as a heat transfer medium so as to avoid exposing a user of the system to harmful effects even if the system should develop leaks.

BRIEF DESCRIPTION OF THE DRAWING

The single figure of the drawing is a partial cross-sectional schematic view of a package-type single-stage oil-free screw compressor constructed in accordance with the present invention.

DETAILED DESCRIPTION

Referring now to the single figure of the drawing, according to this figure, a single-stage oil-free screw compressor system includes a compressor generally designated by the reference numeral 1, a main motor generally designated by the reference numeral 2, a V-belt generally designated by the reference numeral 3, a suction-blocking valve generally designated by the reference numeral 4, a precooler generally designated by the reference numeral 5, an after cooler generally designated by the reference numeral 6, a check valve 7, and oil cooler generally designated by the reference numeral 8, an air filter generally designated by the reference numeral 9, a cooling fan generally designated by the reference numeral 10, a transmission mechanism generally designated by the reference numeral 11, an oil pump 12, a radiator 13, and a coolant pump 14.

The constructional features of the compressor body 1, suction-blocking valve 4, the precooler 5, after cooler or cooler 6, and transmission mechanism 11 may be of the type disclosed in, for example, U.S. Pat. No. 4,529,363.

As shown in the single figure of the drawing, the compressor body 1 includes a casing 1D having a suction port 1A, a discharge port 1B and a jacket 1C, with a male rotor 1E and a female rotor 1F disposed in the casing 1D in such a manner so as to rotatably engage each other, and a timing gear 1G is connected to the bearing of the male and female rotors 1E, 1F. The suction-blocking valve 4 includes a cylinder 4A, a piston 4B, slidably contained in a cylinder 4A, a spring 4C, and a blocking valve 4D connected to the piston 4B and disposed in an intake gas passage of the compressor body 1, pipes 4E and 4F, through which air is supplied to and discharged from the cylinder 4A to move the piston 4B, and solenoid valves 4G, 4H. The precooler 5 includes a shell 5A and a heat transfer tube 5B enclosed in the shell 5A, and is connected to the discharge port 1B of the compressor body 1 through a discharge pipe 15.

The after cooler 6 is connected to the outlet of the heat transfer tube 5B of the precooler 5, and is provided, at an outlet end thereof, with a drain separator 16. The check valve 7 is disposed between the precooler 5 and the after cooler 6. The oil cooler 8 is connected, at an inlet thereof, to an outlet of the oil pump 12 through a piping 16A and is also connected, at an outlet thereof, to a lubricated portion, for example, the timing gear 1G and a bearing, of the compressor body 1 through a piping 16B. Oil, after being discharged from the lubricated portion of the compressor body 1, returns to an oil tank 11A of the speed-increasing transmission mechanism 11 through a piping 17. The cooling fan 10 includes a fan casing 10A and an impeller 10B coupled to a motor 18. The transmission mechanism 11 includes a gear casing 11B having an oil tank 11A, a pinion gear 11C, coupled to the male rotor 1E, and a driving gear 11D engaged with the pinion gear 11C. The oil pump 12 is connected to the shaft of the driving gear 11D through a gear, and communicates with the oil tank 11A through a pipe at an inlet thereof.

The radiator 13 is connected at an outlet thereof, to the jacket 1C through a piping 19A, a coolant pump 14 and a piping 19B, and is also connected at an inlet thereof to an interior of the shell 5A of the precooler 5 through a piping 19C which, in turn, is connected to the jacket 1C through a piping 19D. The coolant pump 14 is coupled with the motor 18 and an intake of the cooling fan 10 is connected to the air outlet of the radiator 13, the after cooler 6 and the oil cooler 8 through a duct 20, so that air is supplied to the cooling fan 10 through the radiator 13, the after cooler 6 and the oil cooler 8.

The above-described components are enclosed by a sound insulation cover generally designated by the reference numeral 21 provided with an air intake 21A for compression, an air intake 21B for cooling the main motor 2, an air intake 21C for ventilation, and an air outlet 21D for cooling. The duct 20 is provided with an air intake 20A through which air in the sound-insulation cover 21 is drawn into the cooling fan 10. A heat transfer tube 22A, branched from the outlet of the heat transfer tube 5B of the precooler 5, is incorporated in the shell 5A, and is connected at its outlet end to a vent valve 23 through a piping 24A, with the vent valve 23 being connected to a silencer 25 through a piping 24B.

A coolant, mainly composed of propylene glycol and containing a metal corrosion inhibitor for copper, aluminum, or iron, or an aqueous solution of substances containing water in the amount of 50–70% by volume is charged in the radiator 13, the jacket 1C, the precooler 5, the coolant pump 14, and the piping which interconnects these components. At least the density or flowing ratio of the propylene glycol is preferably 30% to prevent the system from corrosion.

For operating the rotary-type compressor system constructed in accordance with the present invention, rotation of the main motor 2 is transmitted to the male rotor 1E through the V-shaped drive belt 3, the driving gear 11D and the pinion gear 11C, and is further transmitted to the female rotor 1F through the timing gear 1G so that both rotors 1E and 1F are simultaneously rotated to compress a drawn-in gas such as, for example, air, and discharge the compressed air from the discharge port 1B, with the compressed air having a temperature of about 320° C. The gas is introduced to the heat transfer tube 5B of the precooler 5 through the discharge pipe 15, and is precooled to a temperature which is low enough to flow into the after cooler 6. The gas then flows into the after cooler 6 where it is cooled to a suitable temperature of, for example, about 45° C.

The coolant flows into the jacket 1C from the radiator 13 through the piping 19A, the coolant pump 14 and the piping 19B to absorb the heat from the compressor body 1. The coolant, after absorbing heat, flows into the shell 5A of the precooler 5 through the piping 19D, where it precools the compressed gas passing through the heat transfer tube 5B, and then returns to the radiator 13 through the piping 19C. In the radiator 13, heat of the coolant is dispersed into the atmosphere by cooling air generated by the cooling fan 10 so that the temperature thereof is lowered for reuse.

As apparent from the foregoing description, in accordance with the present invention, the radiator, the compressor body and the precooler together form a circulation circuit through which the cooling medium is circulated. Consequently, it is possible to disperse heat generated in the compressor body and the precooler even when no tap water or underground water is available. Therefore, the oilless screw compressor of the present invention is readily usable at any required place or location. Furthermore, the compressor of the present invention is not subject to corrosion to any substantial extent and, therefore, is suitably employable in the food industry to supply compressed air.

While we have shown and described only one embodiment in accordance with the present invention, it is understood that the same is not limited thereto, but is susceptible to numerous changes and modification as known to one having ordinary skill in the art and we therefore do not wish to be limited to the details shown and described herein, but intend to cover all such modifications as are encompassed by the scope of the appended claims.

We claim:

1. An oilless rotary-type compressor system comprising: a drive means; a transmission means connected to said drive means for increasing a rotational speed of said drive means; a rotary-type compressor means connected to said transmission means including a casing means having a suction port means, a discharge port means, and a jacket means, a pair of meshing screw rotor means rotatably accommodated in said casing means; a precooler means connected to a discharge side of said rotary-type compressor means comprising a heat transfer tube means and a shell means for enclosing said heat transfer tube means; a radiator means connected to said precooler means and said jacket means of said casing means through a circulation passage means for dispersing heat of the heat transfer medium which circulates through said precooler means, said jacket means and said radiator means; fan means for blowing air into said radiator means; a cooler means connected to an outlet side of said precooler means; and a check valve means located in a compressed gas passage means between said precooler means and said cooler means.

2. An oilless rotary-type compressor system according to claim 1, wherein means are provided for enabling the heat transfer medium, after dispersing heat into said radiator means, to flow into said jacket means and then said precooler means before returning to said radiator means and completing the circulation.

3. An oilless rotary-type compressor system according to claim 1, wherein the heat transfer medium which circulates through said radiator means, said jacket means, and said precooler means, includes an aqueous solution of propylene glycol.

4. An oilless rotary-type compressor system according to claim 1, wherein the heat transfer medium is a mixture of propylene glycol, a metal corrosion inhibitor, and water.

5. An oilless rotary-type compressor system according to claim 4, wherein an amount of water is between 50% and 70% by volume.

6. An oilless rotary-type compressor system according to claim 1, wherein the heat transfer medium is a mixture of propylene glycol, a metal corrosion inhibitor, and water added in an amount of 50% to 70% by volume.

7. An oilless rotary-type compressor system comprising: a drive means; transmission means connected to said drive means for increasing a rotational speed thereof; a rotary-type compressor means connected to said transmission means including a casing means having an inlet port means, outlet port means and a jacket means, a pair of meshing screw rotor means rotatably accommodated in said casing means; a precooler means connected to an outlet side of said rotary compressor means; a radiator means connected to said precooler means and said jacket means of said casing means through a circulation passage means, said radiator means dispersing heat from a coolant which is composed essentially of propylene glycol and which circulates through said precooler means, said jacket means, and said radiator means; fan means for blowing air into said radiator means; after cooler means connected to an outlet side of said precooler means; and check valve means located in a compressed gas passage means between said precooler means and said after cooler means.

8. An oilless rotary-type compressor system according to claim 7, wherein said coolant sequentially flows through said radiator means, said jacket means, and said precooler means and returns to said radiator means to complete the circulation.

9. An oilless rotary-type compressor system according to claim 7, wherein said coolant contains water in an amount of 50–70% by volume.

10. An oilless rotary-type compressor system according to claim 7, further comprising a coolant circulating pump means disposed in the circulation passage means of said coolant between said radiator means and said jacket means.

* * * * *